United States Patent [19]

Steinwider et al.

[11] 4,427,184

[45] Jan. 24, 1984

[54] TAPHOLE APPARATUS

[75] Inventors: Rupert Steinwider; Paul Weitzer, both of Vienna, Austria

[73] Assignee: Veitscher Magnesitwerke-Actien-Gesellschaft, Vienna, Austria

[21] Appl. No.: 345,273

[22] Filed: Jan. 25, 1982

[30] Foreign Application Priority Data

Feb. 5, 1981 [AT] Austria ..... 524/81

[51] Int. Cl.[3] ..... C21C 5/46

[52] U.S. Cl. ..... 266/45; 266/236; 266/271; 266/287

[58] Field of Search ..... 266/287, 45, 269, 271, 266/236

[56] References Cited

U.S. PATENT DOCUMENTS 1,565,084 12/1925 Frerichs ..... 266/236
2,286,218 6/1942 Martin ..... 266/236 X
3,343,827 9/1967 Hansen ..... 266/236
3,463,475 8/1969 Buchholz ..... 266/236

FOREIGN PATENT DOCUMENTS 326164 11/1975 Austria .

OTHER PUBLICATIONS

"Schrift ueber Stahlwerks-Verschleissmaterial der Firma Stoecker & Kunz", pp. 22–28, 1964.

*Primary Examiner*—Brian E. Hearn
*Assistant Examiner*—David A. Hey
*Attorney, Agent, or Firm*—Kurt Kelman

[57] ABSTRACT

A taphole apparatus for a steel-making converter, which is comprised of a series of refractory blocks each defining a bore and the bores being aligned to define respective and successive sections of the taphole, the bore of a first one of the refractory blocks at a hot inlet end of the taphole being funnel-shaped and the bore of a last one of the refractory blocks at a cold outlet end of the tap hole having a smaller diameter than the funnel-shaped bore at the hot inlet end.

2 Claims, 2 Drawing Figures

TAPHOLE APPARATUS

Figure 1:
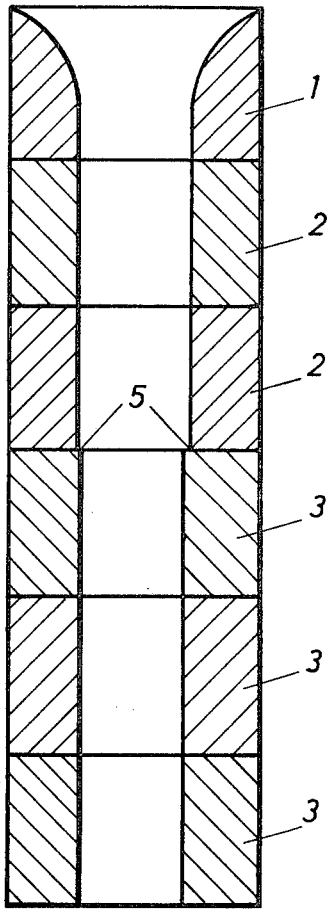

The present invention relates to a taphole apparatus for steel-making converters with a closed taphole, which is comprised of a series of refractory blocks each defining a bore and the bores being aligned to define respective and successive sections of the taphole.

Known converter tapholes have a continuous cylindrical bore throughout their length. Cylindrical tapholes of constant diameter, as disclosed, for example, in U.S. Pat. No. 3,463,475, have the disadvantage of producing excessively long tapping times at the beginning of the tapping operation, and the tapping time is at first rapidly reduced and then is decreased more slowly. The reason for this phenomenon is the constriction of the taphole caused by the steel flowing into the taphole bore. Furthermore, gravity causes a further acceleration of the steel jet penetrating into the taphole and thus produces an additional constriction. Also, essentially only the hot inlet refractory block of the taphole is subjected to wear in cylindrical tapholes so that the blocks froming the taphole are non-uniformly worn, which leads to a short operating life of the taphole apparatus.

It is the primary object of this invention to overcome the above and other disadvantages of conventional taphole apparatus, and the invention accomplishes this object with a taphole apparatus wherein the bore of a first one of the refractory blocks at a hot inlet end of the taphole is funnel-shaped and the bore of a last one of the refractory blocks at a cold outlet end of the tap hole has a smaller diameter than the funnel-shaped bore at the hot inlet end.

According to one preferred feature of the present invention, the diameters of the refractory blocks are conically reduced in the direction of the cold outlet end.

According to another preferred feature of this invention, the bores of the refractory blocks, except for the first block, are cylindrical, the diameters of the bores being gradually reduced in the direction of the cold outlet end. This produces a stepped taphole bore defined in a series of aligned refractory blocks. The shoulders in the stepped bore are worn down in the first tapping positions so that a smooth bore is produced within a very short time.

With a taphole apparatus of this structure, the taphole bore is adapted to the shape of the tapped steel jet and this produces unexpected advantages. The steadiness of the tapping position of the converter is considerably increased. The tapping time is reduced. Even the first taps in a new tapping position produce optimally coherent steel jets. The improved coherence of the steel jet leads to less oxidation thereof. This, in turn, reduces the amount of oxidizing medium used and enhances the quality of the steel produced because it has fewer occlusions. Because the shape of the taphole bore is adapted to the flow conditions, the inlet is less enlarged towards the end of a tapping position than in conventional taphole apparatus and, therefore, less slag is carried along at the end of a tapping operation.

Figure 2:
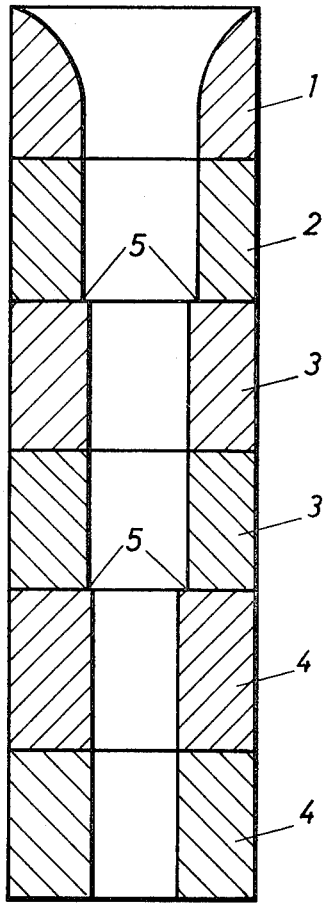

The above and other objects, advantages and features of the present invention will become more apparent from the following detailed description of now preferred embodiments of this invention schematically illustrated in the accompanying drawing wherein FIG. 1 is an axial cross section of one embodiment of a taphole apparatus according to the invention and FIG. 2 is a like view of another embodiment.

The same reference numerals are used in both figures to designate like parts functioning in a like manner.

In FIG. 1, the taphole apparatus is shown to be comprised of a series of refractory blocks 1, 2 and 3 each defining a bore and the bores being aligned to define respective and successive sections of the taphole, a first section being formed by block 1, a second taphole section being formed by two like blocks 2 and a third section being formed by three like blocks 3. In accordance with the present invention, first block 1 at a hot inlet end of the taphole has a funnel-shaped bore and the bore of the three like blocks 3 at a cold outlet end of the taphole has a smaller diameter than the funnel-shaped bore at the hot inlet end. The diameter of intermediate blocks 2 have cylindrical bores of the same diameter as the outlet end of the funnel-shaped bore in block 1.

In the embodiment of FIG. 2, the second taphole section comprises only a single block 2 and this is followed by a further section comprised of two blocks 3 of a diameter smaller than that of the bore in preceding block 2, a fourth taphole being formed by two blocks 4 defining bores of a diameter smaller than that of the bores in blocks 3.

Refractory blocks 2, 3 and 4 are standard taphole apparatus components so that the taphole apparatus of this invention may be readily manufactured from commercially available materials.

Shoulders 5 between the successively smaller bores in the taphole are rapidly worn down at the beginning of the tapping operation so that the taphole will within a very short period of time assume a conically tapering cross-section optimally conforming to the steel jet passing therethrough from the hot inlet to the cold outlet end.

What is claimed is:

1. A taphole apparatus for a steel-making converter, which is comprised of a series of refractory blocks each defining a bore and the bores being aligned to define respective and successive sections of the taphole, the bore of a first one of the refractory blocks at a hot inlet end of the taphole being funnel-shaped and the bore of a last one of the refractory blocks at a cold outlet end of the taphole having a smaller diameter than the funnel-shaped bore at the hot inlet end, the bores of the refractory blocks, except for the first block, being cylindrical and the diameters of the bores being gradually reduced in the direction of the cold outlet end.

2. The taphole apparatus of claim 1, wherein the refractory blocks are discs.

* * * * *